US006336306B1

(12) United States Patent
Sieger et al.

(10) Patent No.: US 6,336,306 B1
(45) **Date of Patent: *Jan. 8, 2002**

(54) ROUND-BALE PRESS AND A METHOD OF COMPRESSING REFUSE

(75) Inventors: Erich Sieger, Friedrichshafen; Thomas Schuster, Kammlach, both of (DE)

(73) Assignee: Petersen, Inc., Ogden, UT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/127,826

(22) Filed: Aug. 3, 1998

(30) Foreign Application Priority Data

Jul. 24, 1998 (WO) ..... PCT/EP98/04646

(51) Int. Cl.[7] ..... B65B 63/04

(52) U.S. Cl. ..... 53/399; 53/430; 53/438; 53/118; 53/587; 100/40; 100/87

(58) Field of Search ..... 100/87, 88, 40; 53/430, 399, 118, 587, 211, 215, 438, 176

(56) References Cited

U.S. PATENT DOCUMENTS

| | | | | | |
|---|---|---|---|---|---|
| 567,548 | A | * | 8/1896 | Owen | 100/87 X |
| 3,964,232 | A | * | 6/1976 | Bender et al. | 53/118 X |
| 3,974,632 | A | * | 8/1976 | Van Der Lely | 100/88 X |
| 4,092,818 | A | * | 6/1978 | Brewster | 100/87 X |
| 4,375,187 | A | | 3/1983 | Kluver et al. | 100/88 |
| 4,685,270 | A | * | 8/1987 | Brambilla | 53/176 |
| 4,841,851 | A | * | 6/1989 | Quataert | 53/587 X |
| 5,581,974 | A | * | 12/1996 | Underhill et al. | 53/587 X |
| 5,638,749 | A | | 6/1997 | Ansbjer et al. | 100/87 |
| 5,727,359 | A | * | 3/1998 | Rampp | 53/587 X |
| 5,822,967 | A | * | 10/1998 | Hood et al. | 100/88 X |

FOREIGN PATENT DOCUMENTS

| | | | | |
|---|---|---|---|---|
| DE | 26 26 263 | | 12/1977 | |
| DE | 39 41 727 A1 | | 6/1991 | |
| EP | 0 574 697 A1 | | 4/1993 | |
| EP | 551228 | * | 7/1993 | 53/118 |
| WO | WO 95/00324 | | 1/1995 | |

* cited by examiner

*Primary Examiner*—Stephen F. Gerrity
(74) *Attorney, Agent, or Firm*—Dorsey & Whitney LLP

(57) ABSTRACT

The invention relates to a round-bale press for compressing refuse into round bales and to such a method. The round-bale press according to the invention enables refuse to be compacted within a compressing chamber (10). For this purpose, an endless belt (12), which together with two side walls (14, 16) defines a compressing chamber (10), is driven. A pivotably supported endless belt segment (24) can be moved out of a refuse compressing position into a discharge position in such a way that the compressed round bale can be discharged from the compressing chamber (10) via this endless belt segment (24).

22 Claims, 6 Drawing Sheets

ROUND-BALE PRESS AND A METHOD OF COMPRESSING REFUSE

TECHNICAL FIELD

The present invention relates to a round-bale press and a method of compressing refuse into round bales.

To supply refuse to thermal processing to obtain heat or power, it is practical to compress the refuse into round bales in round-bale presses for the purpose of transporting and storing the refuse; such round bales are then kept dimensionally stable by means of an outer film which also protects them from the effects of weather.

PRIOR ART

A round-bale press for the production of refuse bales is known for example from DE 39 41 727. Refuse is introduced into a compressing chamber of a round-bale press via a feed hopper. The refuse is compacted inside this compressing chamber by means of wrapping rollers driven at the peripheral side and positioned into a predefined round-bale form. The round bale is then pre-secured by means of a net web. Part of the round-bale press's rear housing wall can be upwardly pivoted for removal of the refuse bale. The refuse bale is then transported over a roller conveyor to a wrapping table where a film is wrapped around this bale in such a way as to pack it in a dimensionally stable, weatherproof and storable manner. The plurality of driven wrapping rollers causes the energy consumption of such a round-bale press to be relatively high during compaction of the refuse bale. Upwardly pivoting part of the housing wall entails considerable construction space for the round-bale press.

A round-bale press which uses a driven link conveyor for compacting and shaping a round bale is known from WO 95/00324. The link conveyor is driven by disk-like side walls which simultaneously form the lateral limit of the compressing chamber. The refuse is pre-compacted and introduced into the compressing chamber via a second link conveyor. After the refuse has been compacted inside the compressing chamber and has been formed into a round bale, the round bale is pre-secured using a net web. To discharge the refuse bale from the compressing chamber, a plurality of endless belt segments of the link conveyor guidance are pivoted outwards. The refuse bale, which is still held between the two side walls, is then lifted, together with these side walls, out of the opened compressing chamber via lever arms. As soon as the side walls release the refuse bale, it can be conveyed to the wrapping table via an additional conveyor belt. This round-bale press version also needs considerable construction space above the compressing chamber in order to remove the refuse bale. Additional conveyance means for moving the pre-secured refuse bale from the compressing chamber to the wrapping table increase the construction costs of such a refuse packing device and consume additional energy.

DEPICTION OF THE INVENTION

A technical problem underlying the invention is to provide a round-bale press for packing refuse, the constructional outlay of which is simplified and which needs less construction space.

This technical problem is solved by a round-bale press for compressing refuse into round bales. Such a round-bale press comprises: a compressing chamber into which the refuse can be introduced, a driven endless belt that limits the compressing chamber at the peripheral side and rotates the refuse contained therein, and two side walls formed as circular disks and which limit the compressing chamber at the end face, whereby an endless belt segment of the endless belt can be pivoted by at least one drive element out of a refuse compressing position into a discharge position in which the obtained round bale can be removed on the pivoted endless belt segment.

The invention is also based upon the technical problem of providing a round-bale press that can be used to simplify removal of the pre-secured refuse bales from the compressing chamber.

This problem is solved by a round-bale press comprising: a compressing chamber into which the refuse can be introduced, a driven endless belt that limits the compressing chamber at the peripheral side and rotates the refuse contained therein, and two side walls which limit the compressing chamber at the end face, whereby an endless belt segment of the endless belt can be pivoted out of a refuse compressing position into a discharge position in which the obtained round bale can be removed on the pivoted endless belt segment.

The invention is also based upon the technical problem of designing a round-bale press for compressing refuse into round bales that ensures long-lasting and reliable operation.

This technical problem is solved by a round-bale press for compressing refuse into round bales comprising: a compressing chamber into which the refuse can be introduced, a driven endless belt which limits the compressing chamber at the peripheral side and rotates the refuse contained therein, and two side walls which limit the compressing chamber at the end face, whereby an endless belt segment of the endless belt can be pivoted out of a refuse compressing position into a discharge position in which the obtained round bale can be removed on the pivoted endless belt segment, with the endless belt being a link conveyor whose links are made of aluminum or an aluminum alloy.

Finally, the invention is based on the problem of providing a simple and inexpensive method of compressing and discharging round bales of refuse. This problem is solved by a method of compressing and discharging refuse in round bales; in this method refuse is introduced through a feed aperture into a compressing chamber defined by an endless belt—guided by one of a plurality of deflection rollers—and two side walls, the refuse is rotated inside the compressing chamber and refuse continues to be introduced until a refuse bale of a predetermined size is produced, a securing means, such as a net web, is then wrapped, at the peripheral side, around this refuse bale produced in the above manner, a pivotably supported endless belt segment of the endless belt is pivoted out of the refuse compressing position into a position for discharging the round bale, thus creating a transport path for the compressed round bale to a wrapping table downstream of the compressing chamber, and the refuse bale that is secured at the peripheral side is removed from the compressing chamber by the endless belt via the pivoted endless belt segment as a result of letting the endless belt run.

The invention is based upon the idea that the endless belt, which together with two end-face side walls defines the compressing chamber for the purpose of receiving the refuse and compressing it into round bales, is also used for the first time as a discharge means. A compressed round bale can be discharged without additional constructional outlay as a result of an endless belt segment which is pivoted out of a refuse compressing position into a discharge position. Until now, separate devices had been necessary for this purpose.

A conveyor means for transporting the pre-secured refuse bales to the wrapping table can be replaced by the pivotably supported endless belt segment of the compressing chamber, with the endless belt assuming the function of a conveyor belt. The pivoted endless belt segment preferably bridges over the space necessary for the wrapping device between the round-bale press and the wrapping table on which a film web is then completely wrapped around the pre-secured refuse bale in order to protect it from the effects of weather and to keep it dimensionally rigid. In this way, the space required by the round-bale press above the compressing chamber is not only reduced, but the space needed between the compressing chamber and the wrapping table is also decreased.

Further preferred embodiments are characterized by the dependent claims.

The endless belt is preferably guided via at least four deflection rollers, whereby in order to discharge the round bale from the compressing chamber, an endless belt segment to which at least one of these deflection rollers is attached can be pivoted such that the endless belt segment preferably pivots away around the axis of one of the deflection rollers. The use of fewer deflection rollers considerably reduces the endless belt/deflection roller system's design-related resistance.

According to a preferred embodiment, at least one of the deflection rollers of the endless belt is designed as a drive roller. This ensures that the endless belt is driven irrespective of whether it engages with the optionally disk-like side walls. Another of the deflection rollers is preferably designed as a tension roller that tensions the endless belt, with the deflection roller arrangement according to the invention ensuring that this tension is disposed on the slack side. The arrangement of a tension roller on the slack side of the endless belt simplifies the introduction of a defined pre-tension into the endless belt.

According to another preferred embodiment, another roller that deflects the endless belt is arranged on the pivotably supported endless belt segment; this roller also contributes toward compacting the refuse inside the compressing chamber. This additional compaction roller improves the endless belt's guidance and compaction characteristics.

A means for pre-securing the compacted round bale is preferably provided at or within the compressing chamber. This may for example be a means of wrapping yarn or a net web around the round bale.

The pivotably supported endless belt segment of the compressing chamber is preferably moved via a drive element. Hydraulic or pneumatic piston drives have particularly proved beneficial for this purpose. The use of a rack in conjunction with an electric motor that drives a pinion is also possible.

According to a preferred embodiment, a defined aperture through which refuse can be introduced into the compressing chamber is obtained between two deflection rollers once the pivotable endless belt segment has been folded up into a compaction position. A special conveyor device which pre-compacts and transports the refuse to be fed into the compressing chamber is not absolutely necessary, but can be provided if required.

According to another preferred embodiment, ribs which point into the compressing chamber are attached to the endless belt. The width of the endless belt is preferably larger than the distance between the two side walls which are ideally formed as circular plates. The endless belt passes at least in part around the side walls. The compressing chamber side walls are preferably rotatably supported, causing them to rotate together with the refuse, driven by the endless belt. In this instance, the ribs are arranged only in an endless belt section located between the two disk-like side walls. These ribs help the refuse to be rotated inside the compressing chamber, thus compressing it into a refuse bale of a predetermined size. These ribs also improve the endless belt's conveyance characteristics when discharging the refuse bale from the compressing chamber.

The endless belt is preferably a link conveyor. The link conveyor's individual links are joined together in an overlapping manner by means of bars. The bars are received by bores in the individual links, with the bores each being designed as clearance fit on the one side, whereas they are designed as transition fit on the other side of the links. In this way, it is ensured that the link conveyor's individual links bend at defined sites during deflection via the deflection rollers. To reduce the weight, it is advantageous to produce the link conveyor's links from aluminum or an aluminum alloy. Apart from its low specific weight, this material simultaneously exhibits good resistance to corrosion. Depending on the refuse material to be compressed, the use of various plastics or other metals is also suitable for the link conveyor's links.

According to a final embodiment, the device for packing refuse also comprises a spray means which can on the one hand clean the endless belt, but which can also lubricate the endless belt. Lubrication of the link conveyor's joints is necessary particularly if dry refuse is used. Another advantage of such a spray means is that dust from dry refuse can largely be prevented from whirling up when the link conveyor is sprayed e.g. with an emulsion of oil and water.

SHORT DESCRIPTION OF THE DRAWINGS

The invention will now be described purely by way of example on the basis of the attached drawings.

DESCRIPTION OF THE INVENTION'S EXEMPLARY EMBODIMENTS

Figure 1:
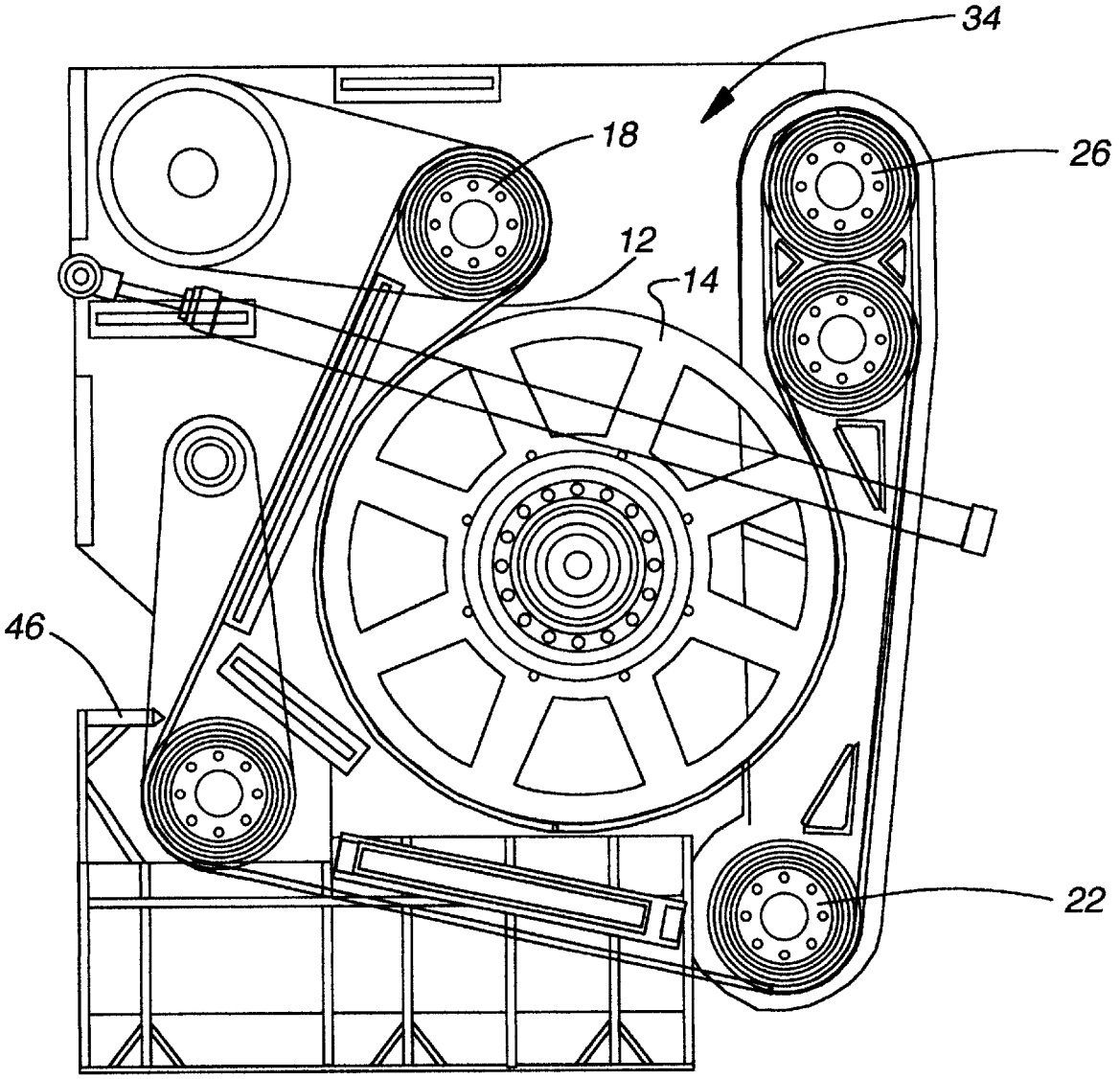
FIG. 1 shows a round-bale press according to the invention comprising a pivotable endless belt segment folded up into a refuse compressing position.
Figure 2:
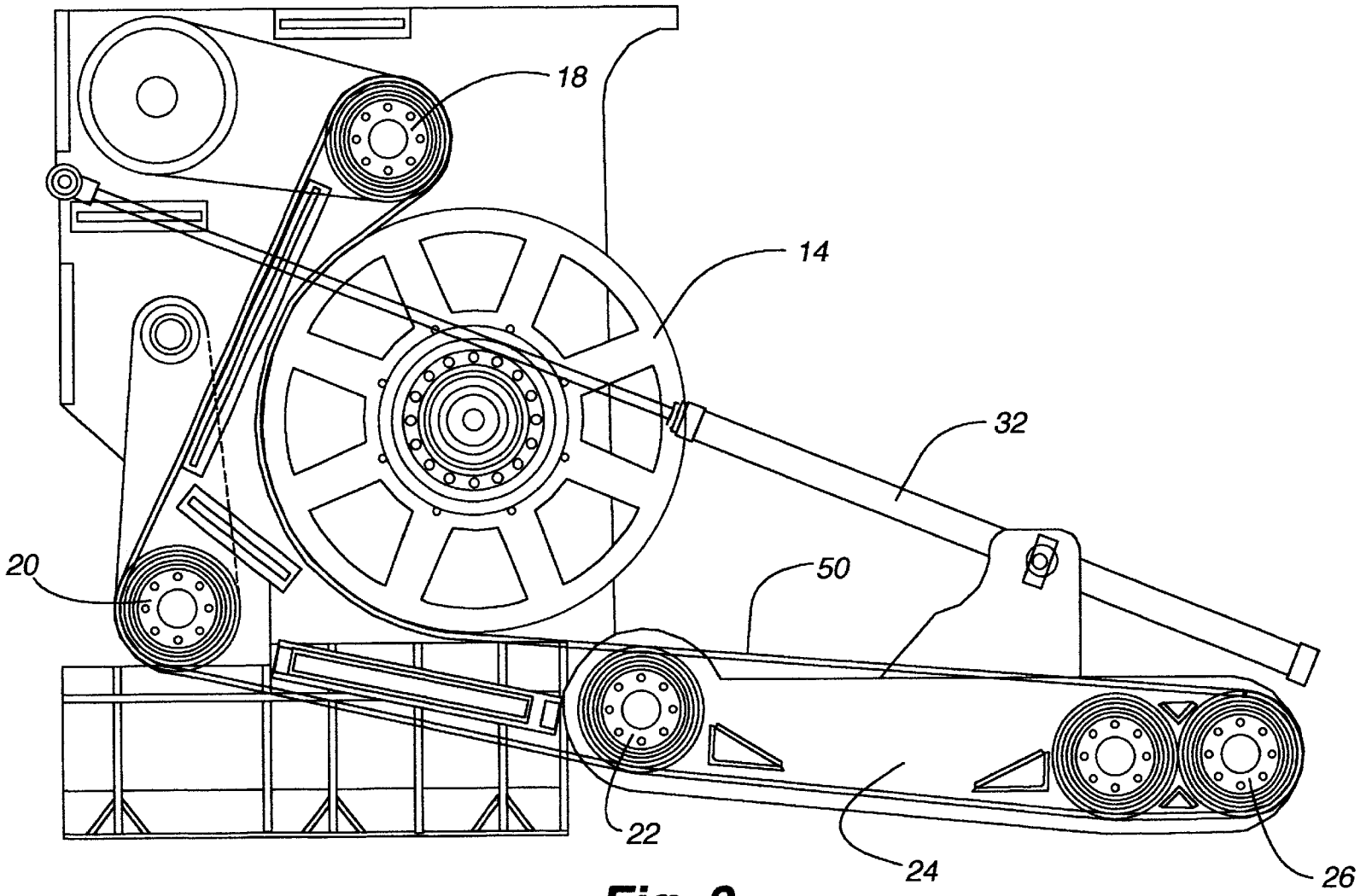
FIG. 2 shows a side view of a round-bale press according to the invention comprising a pivotable endless belt segment folded down into a position for discharging round bales.

A round-bale press according to the invention depicted in FIG. 1 comprises an endless belt 12 guided around a plurality of deflection rollers 18, 20, 22, 26 and 30 and via two disk-like side walls 14 and 16. This defines a compressing chamber 10 into which refuse to be compacted can be fed via a feed aperture 34. An endless belt segment 24 is pivotably supported around the axis of one of the deflection rollers 22, thus enabling the endless belt segment 24 with deflection rollers 26 and 30 attached thereto to be pivoted out of the largely vertical position shown in FIG. 1—and suitable for compacting refuse into round bales—into a largely horizontal position shown in FIG. 2 and suitable for discharging the round bale from the compressing chamber and conveying the round bale to a wrapping table. The endless belt segment 24 is moved via a hydraulic or pneumatic piston drive 32 secured both to the endless belt segment 24 and to the round-bale press frame.

The endless belt 12 is driven via a deflection roller 18 designed as a drive roller. Another deflection roller 20 is designed as a tension roller, with the tension roller 20 being disposed on the slack side of the endless belt 12.

Figure 3:
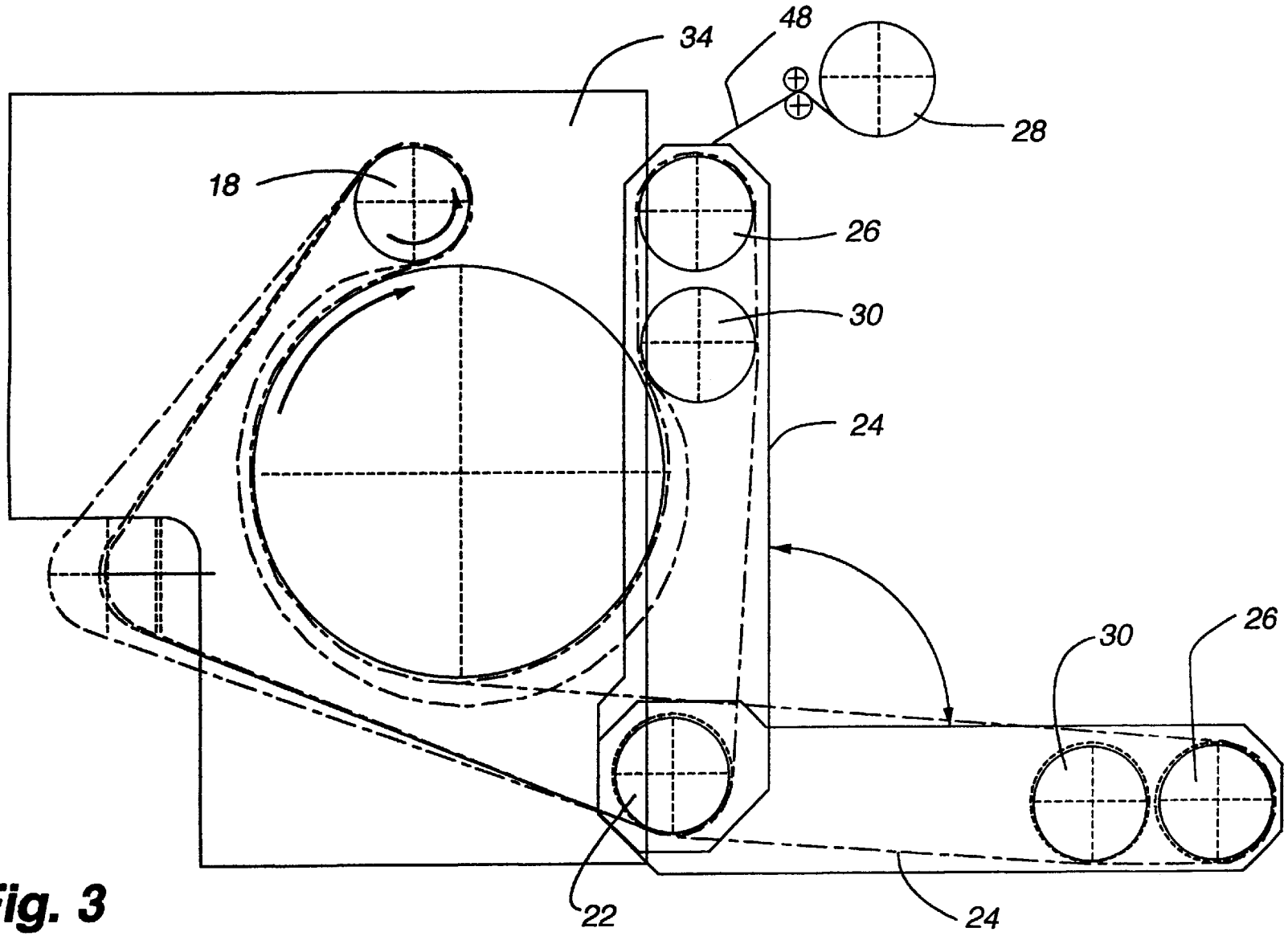
FIG. 3 shows a schematic arrangement of deflection rollers and endless belt according to the present invention.
Figure 4:
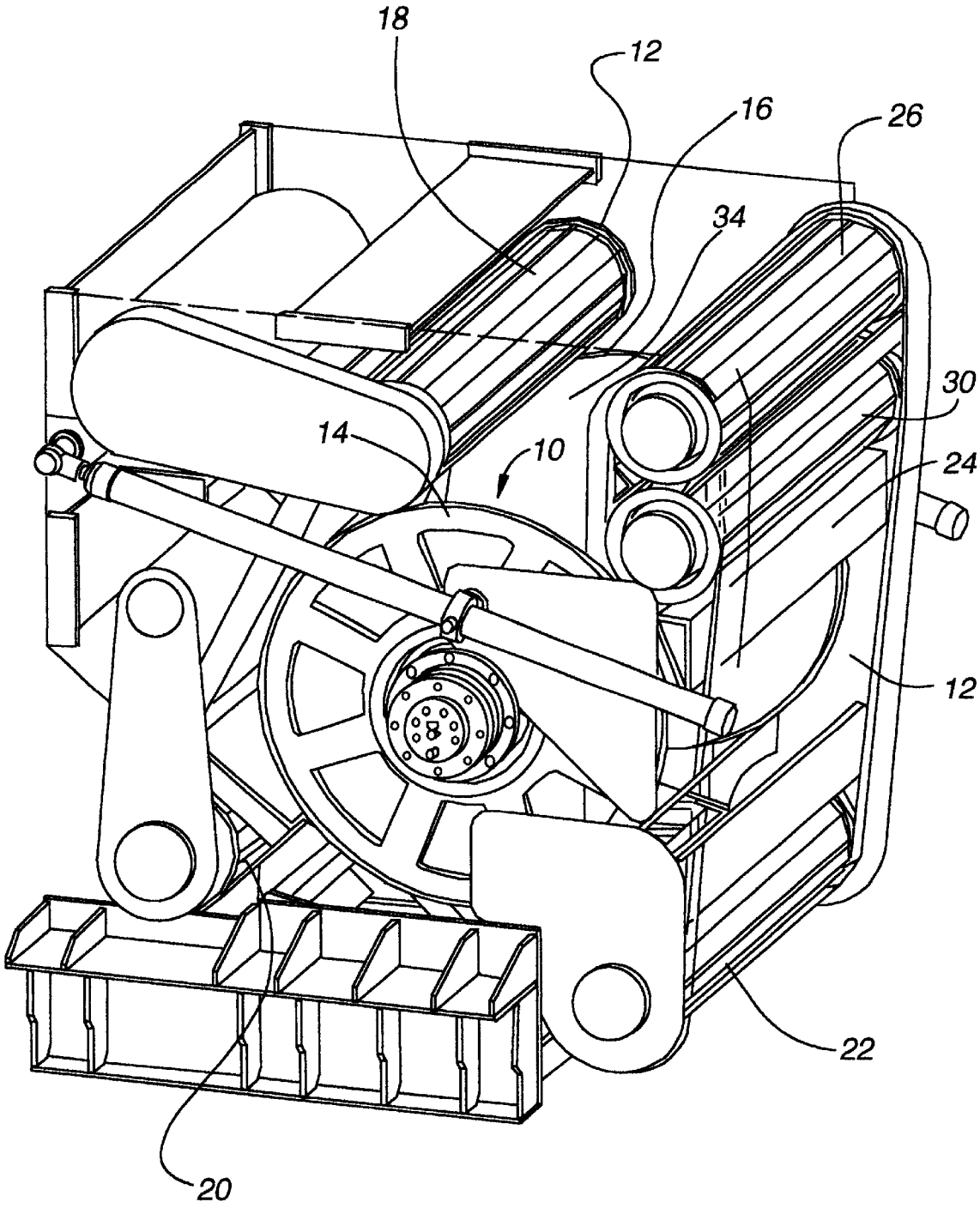
FIG. 4 shows a perspective representation of a round-bale press according to the invention in FIG. 1.
Figure 6:
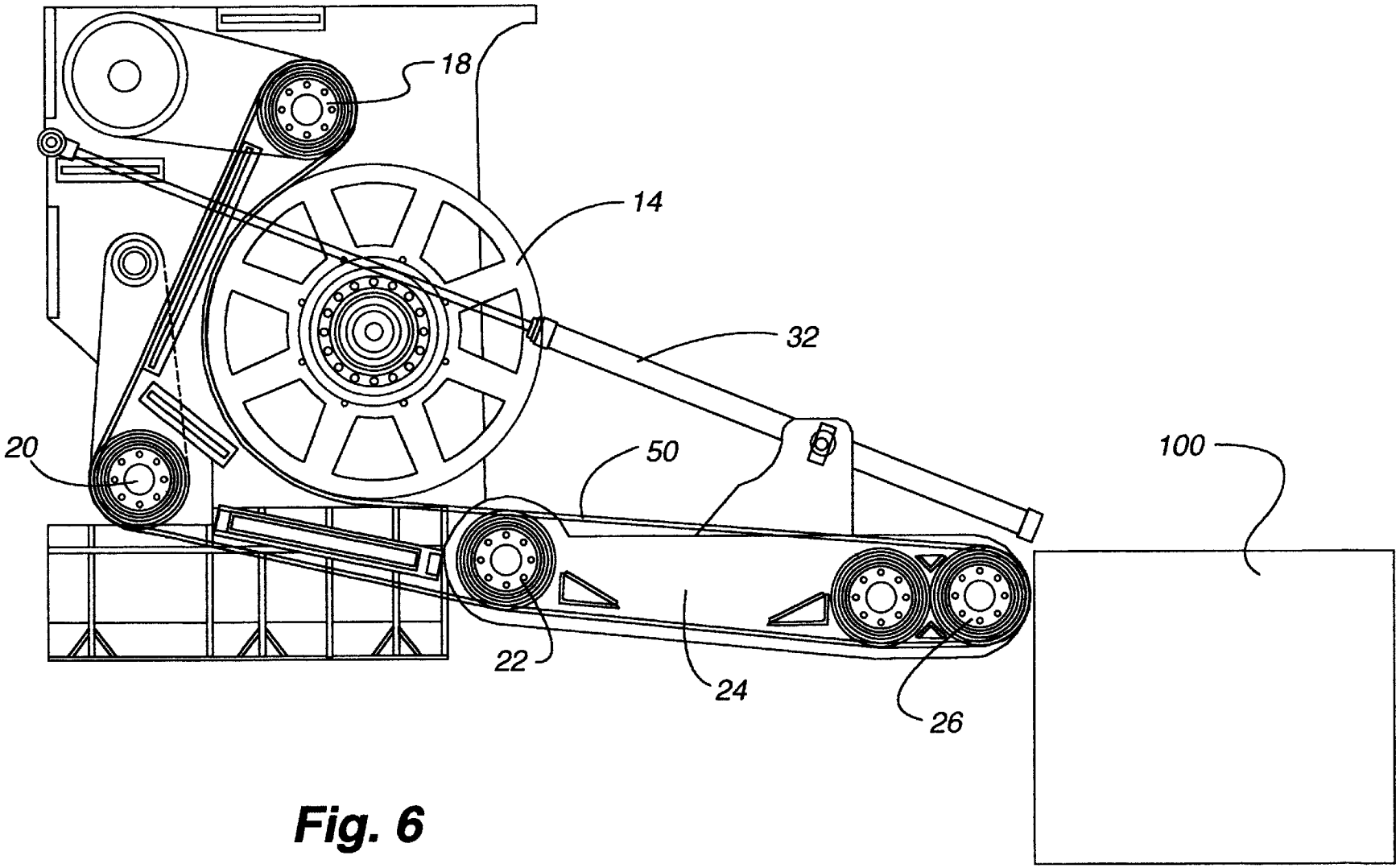
FIG. 6 shows a side view of a round-bale press and a wrapping table according to the invention.

FIG. 3 also shows a means 28 for pre-securing the compressed round bale. This may for example be a means for unwinding yarns or net webs 48. Pre-securing is intended to keep the compacted round bale dimensionally stable in the peripheral direction while it is being conveyed out of the round-bale press to the wrapping table 100—shown in FIG. 6 where a film web is wrapped completely around the bale. This film web permanently secures the round bale in its shape, thereby preventing loss of refuse during the round bale's transportation or storage, or damage to the refuse bale as a result of the effects of weather.

The pivotability—shown in FIG. 3—of the endless belt segment 24 with deflection rollers 26 and 30 attached thereto guarantees that the compacted round bale is directly discharged from the compressing chamber 10 via the endless belt 12 acting as a conveyor belt 50 and rotating over the endless belt segment 24 that is pivoted into a largely horizontal position. The wrapping table is arranged such that the distance between the wrapping table and the round-bale press is bridged exactly by the endless belt segment 24 folded down to a transport path 50. In this way, the compacted and pre-secured round bale can be conveyed as a result of letting the endless belt 12 run, without having to lift the bale out of the compressing chamber 10 via a grab arm.

Figure 5:
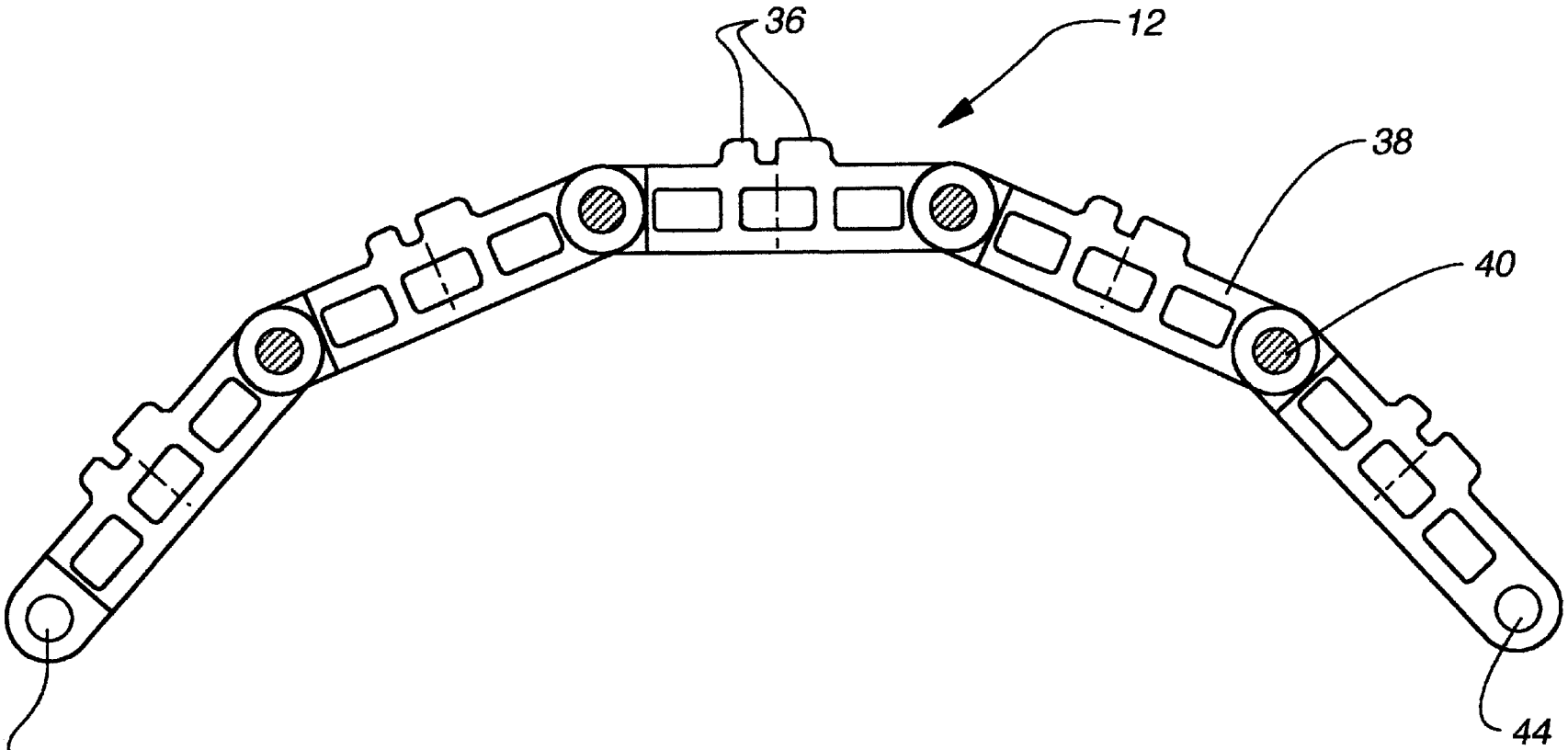
FIG. 5 shows links according to the invention which are combined into a link conveyor.

In FIG. 5, the endless belt 12 according to an exemplary embodiment is designed as a link conveyor. The individual links 38 of the link conveyor 12 are joined together via bars 40. At one end, the links 38 comprise bores 42 with a clearance fit; at their other end, the links 38 comprise bores 44 with a transition fit. This ensures that the connection of the individual links 38 by the bars 40 forms a defined hinge element.

The links 38 of the link conveyor 12 comprise ribs 36 on one side, as is evident from FIG. 5. These ribs 36 are arranged such as to be located on a section of the link conveyor 12 situated between the two disk-like side walls 14 and 16, and point into the compressing chamber 10.

To clean and lubricate the link conveyor 12 there is provided a spray means 46 shown in FIG. 1 and which sprays water or an emulsion of oil and water onto the individual links 38 of the link conveyor 12 at a high pressure. The use of this spray means 46 is particularly necessary if dry refuse is used in the round-bale press in order to ensure the necessary lubrication of the individual links 38 of the link conveyor 12.

What is claimed is:

1. A round-bale press for compressing refuse into round bales, comprising a compressing chamber to receive introduced refuse, the compressing chamber having a periphery and opposite end faces, a driven endless belt guided by a plurality of deflection rollers, the endless belt limiting the periphery of said compressing chamber and rotating the refuse contained therein, and spaced side walls defined by circular disks and limiting the opposite end faces of said compressing chamber, wherein an endless belt segment of said endless belt is pivotable about an axis of one of the deflection rollers by at least one drive element out of a refuse compressing position into a discharge position for discharging a compressed round bale from the compression chamber on said pivoted endless belt segment.

2. A round-bale press according to claim 1 including at least three deflective rollers to support said endless belt, one of said at least three deflection rollers being a drive roller for driving said endless belt and another one of said at least three deflection rollers being a tension roller for tensioning said endless belt.

3. A round-bale press according to claim 2, including a fourth deflection roller to support said endless belt and disposed on a swinging end of said pivotable endless belt segment.

4. A round-bale press according to claim 3 including a fifth deflection roller disposed on said pivotable endless belt segment as a compression roller.

5. A round-bale press according to claim 3, wherein a refuse feed aperture is provided between said drive roller and said fourth deflection roller.

6. A round-bale press according to claim 1, wherein said drive element is a hydraulic piston drive.

7. A round-bale press according to claim 1, wherein said drive element is a pneumatic piston drive.

8. A round-bale press according to claim 1 wherein the width of said endless belt is larger than the space between said side walls.

9. A round-bale press according to claim 1 or 8, wherein said endless belt comprises ribs between said side walls.

10. A round-bale press according to claim 1, wherein said endless belt is a link conveyor having individual links.

11. A round-bale press-according to claim 10, wherein said individual links comprise bores with clearance fit for connection together by bars on one end of each link and bores with transition fit on the opposite end of each link.

12. A round-bale press according to claim 10 or 11, wherein said links of said link conveyor are made of aluminum or an aluminum alloy.

13. A round-bale press according to claim 1 including means for securing said compressed round bale at least on the periphery thereof.

14. A round-bale press for compressing refuse into round bales, comprising a compressing chamber to receive introduced refuse, the compressing chamber having a periphery and opposite ends, a driven endless belt guided by a plurality of deflection rollers, the endless belt limiting the periphery of said compressing chamber and rotating the refuse contained therein, and two side walls limiting the opposite ends of said compressing chamber, wherein an endless belt segment of said endless belt is pivotable about an axis of one of the deflection rollers out of a refuse compressing position into a discharge position for discharging a compressed round bale from the compressing chamber on said pivoted endless belt segment.

15. A round-bale press according to claim 14, wherein said pivotably supported endless belt segment is movable by at least one drive element.

16. A round-bale press according to claim 14, including means for securing said compressed round bale on the periphery thereof.

17. A round-bale press for compressing refuse into round bales, comprising a compressing chamber to receive introduced refuse, the compressing chamber having a periphery and opposite ends, a driven endless link conveyor belt guided by a plurality of deflection rollers, the endless belt limiting the periphery of said compressing chamber and rotating the refuse contained therein, and two side walls limiting the opposite ends of said compressing chamber, wherein an endless belt segment of said endless belt is pivotable about an axis of one of the deflection rollers out of a refuse compressing position into a discharge position for discharging a compressed round bale from the compressing chamber on said pivoted endless belt segment, and wherein said endless link conveyor belt has links made of aluminum or an aluminum alloy.

18. A round-bale press according to claim 17, including at least one spray means for cleaning said endless belt.

19. A round-bale press according to claim 17, including spray means for lubricating said endless belt.

20. A method of compressing and discharging refuse in round bales, comprising the steps of:

introducing refuse through a feed aperture into a compressing chamber defined by an endless belt guided by one of a plurality of deflection rollers, and two side walls;

rotating the refuse inside said compressing chamber while refuse continues to be introduced until a refuse bale of a predetermined size is produced;

wrapping a securing means around a periphery of said refuse bale produced by said introducing and said rotating steps;

pivoting a pivotably supported endless belt segment of said endless belt about an axis of one of the deflection rollers out of a refuse compressing position into a position for discharging said refuse bale; and discharging the refuse bale from said compressing chamber by said endless belt via said pivoted endless belt segment as a result of letting said endless belt run.

21. A method according to claim 20 including the additional step of wrapping a film web completely around said refuse bale and said securing means.

22. In a system for compressing refuse into round bales, comprising a round-bale press and a wrapping table spaced from the round-bale press by a fixed distance, the improvement wherein the round-bale press comprises:

a compressing chamber to receive introduced refuse, the compressing chamber having a periphery and opposite end faces;

a driven endless belt guided by a plurality of deflection rollers that limits the periphery of said compressing chamber and rotates the refuse contained therein;

spaced side walls defined by circular disks and limiting the opposite end faces of said compressing chamber; and wherein the endless belt includes an endless belt segment that is pivotable by at least one drive element about an axis of one of the deflection rollers out of a refuse compressing position into a discharge position for discharging a compressed round bale from the compression chamber on said pivoted endless belt segment, and wherein said endless belt segment, in the discharge position, bridges the fixed distance between the round-bale press and the wrapping table.

* * * * *